US012492514B2

(12) United States Patent
Tse et al.

(10) Patent No.: US 12,492,514 B2
(45) Date of Patent: Dec. 9, 2025

(54) RAIL DAMPER MOUNTING APPARATUS AND RAIL DAMPER SYSTEMS CONTAINING THE SAME

(71) Applicant: Talent Power Limited, N.T. (HK)

(72) Inventors: Tsz Fung Dominic Tse, N.T. (HK); Wai Lun Ho, N.T. (HK)

(73) Assignee: Talent Power Limited, N.T. (HK)

( * ) Notice: Subject to any disclaimer, the term of this patent is extended or adjusted under 35 U.S.C. 154(b) by 731 days.

(21) Appl. No.: 17/793,904

(22) PCT Filed: Apr. 20, 2021

(86) PCT No.: PCT/CN2021/088495
§ 371 (c)(1),
(2) Date: Jul. 19, 2022

(87) PCT Pub. No.: WO2021/218713
PCT Pub. Date: Nov. 4, 2021

(65) Prior Publication Data

US 2023/0049253 A1 Feb. 16, 2023

Related U.S. Application Data

(60) Provisional application No. 63/016,312, filed on Apr. 28, 2020.

(51) Int. Cl.
*E01B 19/00* (2006.01)
*E01B 29/32* (2006.01)

(52) U.S. Cl.
CPC ..... *E01B 19/003* (2013.01); *E01B 29/32* (2013.01)

(58) Field of Classification Search
CPC . E01B 9/60; E01B 9/62; E01B 19/003; E01B 29/32
See application file for complete search history.

(56) References Cited

U.S. PATENT DOCUMENTS

| | | | |
|---|---|---|---|
| 6,213,407 | B1 | 4/2001 | Ellis et al. |
| 7,717,387 | B2 | 5/2010 | Naheem |
| 2006/0150563 | A1 | 7/2006 | Naheem |
| 2022/0170215 | A1 | 6/2022 | Oldewurtel et al. |

FOREIGN PATENT DOCUMENTS

| | | |
|---|---|---|
| AU | 2021263618 | 6/2022 |
| CN | 202925403 | 5/2013 |
| CN | 104005309 | 8/2014 |
| CN | 205012161 | 2/2016 |
| CN | 109537375 | 3/2019 |
| EP | 0761879 | 3/1997 |

(Continued)

*Primary Examiner* — Robert J McCarry, Jr.
(74) *Attorney, Agent, or Firm* — Wells St. John P.S.

(57) ABSTRACT

A rail damper mounting apparatus including a clipping device adapted to clip onto a rail, and a mounting device adapted to allow an oscillator to secure thereto. The rail damper mounting apparatus forms at least three clipping points with a rail when the rail damper mounting device is installed to the rail. A rail damping system containing one or more such rail damper mounting apparatus is also disclosed. With at least three clipping points/areas in the mount apparatus, it provides a strong clipping force compressing the wedge-liked rail foot by a very stiff clip.

12 Claims, 9 Drawing Sheets

(56) References Cited

FOREIGN PATENT DOCUMENTS

| | | | | |
|---|---|---|---|---|
| EP | 0995837 | | 8/2005 | |
| EP | 1693516 | | 8/2006 | |
| EP | 1681391 | | 7/2007 | |
| EP | 1876295 | A2 * | 1/2008 | ..... E01B 19/003 |
| EP | 1876295 | | 9/2010 | |
| EP | 3783151 | | 2/2021 | |
| EP | 21797137 | | 9/2023 | |
| FR | 2313501 | | 12/1976 | |
| GB | 22086763 | | 10/2023 | |
| KR | 10-1768996 | | 8/2017 | |
| WO | WO PCT/CN2021/088495 | | 7/2021 | |

* cited by examiner

RAIL DAMPER MOUNTING APPARATUS AND RAIL DAMPER SYSTEMS CONTAINING THE SAME

RELATED PATENT DATA

This application is a 35 U.S.C. § 371 of and claims priority to PCT International Application No. PCT/CN2021/088495, which was filed 20 Apr. 2021 (20.04.2021), was published in English, and which claims the benefit of U.S. Provisional Application No. 63/016,312, which was filed Apr. 28, 2020, the teachings of which are incorporated herein by reference.

TECHNICAL FIELD

This invention relates to railway installations, and in particular to rail damper structures for reduction of rail vibration and noise generated from the railway.

BACKGROUND ART

Over the past two decades, railway dampers have been widely used to reduce railway noises in newly developed railway lines and as an improved noise reduction measure in operating railways. Rail dampers are generally designed to cover a large surface area on rail foot and rail web at both sides of the rail by a thin layer of resilient interface material. However, track engineers would like to have clear views on the rail surface during routine maintenance inspections. A rail damper with a small contact area on the rail is needed so that more rail surface is visible during routine maintenance inspections.

For safety concern on rail integrity, bolts through rails are normally not allowed for mounting of rail dampers. Adhesives on the other hand normally cannot provide a rigid connection for retrofitting dampers onto operating rails due to adhesive resilient property, uncontrolled rust surface and unknown profile tolerance.

In the railway industry, spring clips with hooks (sometimes also with adhesive applied at the interface between the damper and the rail) is a common method for installation of rail dampers. However, mounting clips with a hook in conventional designs cannot utilize its maximum clipping force because the installation process always exerts additional stress on the clip during the locking process of the hook.

When the Tuned Mass Damper (TMD) type of rail dampers vibrates with the rail, its reaction damping force is amplified to several times its weight. A higher TMD amplification factor provides a higher damping force at a frequency-narrower bandwidth, but it also requires a higher mounting force. Rail damper mounting clips in conventional designs (even with the adhesive applied) cannot provide sufficient mounting force to overcome the amplified TMD reaction force. In general, mounting force is required to be more than 1 ton per damper in the case of a strong rail vibration (~50 g rail vibration acceleration after damper installation; for example, a 300 g rail vibration being reduced to around 50 g by the damper installation). Clips currently used in the industry only provide a mounting force up to a few hundred kilograms per damper. Existing rail dampers would be temporarily disengaged from the rail by a few micrometers (or fractions of micrometers) in case of a strong rail vibration due to insufficient mounting force to overcome the acceleration force at peaks of oscillation cycles.

SUMMARY OF INVENTION

Technical Problem

An improved design of the damper mounting clip is, therefore, required to avoid applying additional stress to the mounting clip during damper installation. In addition, a mounting clip with a higher mounting force is desired.

Solution to Problem

Technical Solution

Accordingly, the present invention, in one aspect, is a rail damper mounting apparatus that contains a clipping device adapted to clip onto a rail, and a mounting device adapted to allow an oscillator to secure thereto. The rail damper mounting apparatus forms at least three clipping points with a rail when the rail damper mounting device is installed to the rail.

In some embodiments, the mounting apparatus forms two clipping points located above a plane defined by foot tips on of the rail on two sides of the rail, and one clipping point below the plane, when the rail damper mounting apparatus is installed to the rail.

In some embodiments, the clipping device contains a rail web contact member and a rail foot contact member. The rail web contact member forms respectively a first clipping point and a second clipping point above the plane at a foot and a web of the rail respectively, when the rail damper mounting apparatus is installed to the rail. The rail foot contact member forms a third clipping point below the plane at the foot of the rail.

In some embodiments, the rail web contact member has a side edge in a curved shape that faces the web of the rail when the rail damper mounting apparatus is installed to the rail.

In some embodiments, the rail web contact member is formed as a single piece with the rail foot contact member. The side edge forms the first and second clipping points when the rail damper mounting apparatus is installed to the rail.

In some embodiments, the rail web contact member is formed as a single piece with the mounting device, where the side edge at least partially follows the contour of an oscillator installed to the mounting device.

In some embodiments, the first and second clipping points are located on the side edge at substantially the same radial distance from a rotating center defined by an intersection of two lines respectively normal to tangential lines at the first and second clipping points.

In some embodiments, the mounting apparatus forms one clipping point located above a plane defined by foot tips of the rail on two sides of the rail, and two clipping points below the plane, when the rail damper mounting apparatus is installed to the rail.

In some embodiments, the clipping device includes a rail foot contact member and a hook member. The rail foot contact member forms respectively a first clipping point and a second clipping point with the foot of the rail, when the rail damper mounting apparatus is installed to the rail. The hook member forms a third clipping point with the foot of the rail.

In some embodiments, the rail foot contact member and the hook member are located on the two sides of the rail, and are connected through an extension arm that runs parallel to a bottom face of the foot of the rail when the rail damper mounting apparatus is installed to the rail.

In some embodiments, the hook member forms an inward tip which is adapted to contact the foot of the rail to form the third clipping point.

In some embodiments, the hook member includes a hook portion having an opening substantially toward a direction away from the foot of the rail when the rail damper mounting apparatus is installed to the rail.

In some embodiments, the hook member contains a hook portion having an opening substantially toward an opposite direction to that of the recess of the hook member.

In some embodiments, the extension arm is at least partially resilient so that the clipping device can be clipped onto the rail by moving the hook member in a direction substantially perpendicular to a longitudinal direction of the extension arm using an external tool.

In some embodiments, the rail foot contact member contains a slot for receiving the foot of the rail from a side direction. The second clipping point is formed between a bottom face of the foot of the rail and the slot when the rail damper mounting apparatus is installed to the rail.

In some embodiments, the second and third clipping points are located at the bottom face of the foot of the rail when the rail damper mounting apparatus is installed to the rail.

In some embodiments, the mounting device has a plate shape. The mounting device is adapted to allow two oscillators to secure thereto at two sides of the plate shape.

In some embodiments, the rail damper mounting apparatus is adapted to be connected to a similar rail damper mounting apparatus on an opposite side of the rail by an extension arm.

According to another aspect of the invention, there is disclosed a rail damper system containing a plurality of rail damper mounting apparatus as mentioned above, which are installed to a railway, and oscillators installed to each rail damper mounting apparatus. The plurality of rail damper mounting apparatus is positioned along a longitudinal direction of a rail, and/or positioned symmetrically on two rails of the railway.

Advantageous Effects of Invention

Advantageous Effects

There are many advantages to the present invention. Firstly, with at least three clipping points/areas with the rail formed by each rail damper mounting apparatus, it provides a strong clipping force compressing the wedge-liked rail foot by a very stiff clip, where the bending stiffness of the clip at the top surface clipping point/area is roughly in the order of a fraction of a ton per millimeter to a few tons per millimeter. A strong clip compression force is applied to the foot of the rail to ensure a rigid connection for vibration energy transmission from the rail to the oscillator (e.g. a TMD oscillator) for dissipation.

In addition, the rail damper mounting apparatus has a modular design, which means that each such apparatus is independently installed onto a rail, or two rails of a railway, such that the number of mounting apparatuses can be adjusted flexibly to suit the site conditions. The repetitive modular design simplifies rail damper assembling process and enhances large scale production for cheaper manufacturing. In this way, any desired length between the sleeper spacing of the rail may be equipped with the rail damper mounting apparatuses according to the invention, and these rail damper mounting apparatuses together form a rail damper system. In one example of the rail damper system, pairs of rail damper mounting apparatuses can be installed symmetrically on one of the two rails of a railway, along the length of the railway. In another example of the rail damper system, pairs of rail damper mounting apparatuses can be installed symmetrically on each rail of a railway so that along a lateral direction of the railway there are in total four damper mounting apparatuses installed.

The design of the rail damper mounting apparatus with a small area at the contact interface provides fewer obstructions to the inspecting staffs for routine visual inspections maintenance comparing with conventional rail damper products in the market.

According to some embodiments of the invention, the number of dampers installed on each rail can be chosen from only one to a few (for example, it can be 1, 2 or 3 oscillators), and for example oscillators can be connected to two sides of a circular mounting device in the form of a plate. Such a mounting device is a metal plate without a joint, which is integrated with a stiff clipping device (and sometimes also including an integrated hook member). The clipping device contains a rail foot contact member (and sometimes also including a rail web contact member) that provides a strong vertical mounting force when it is dragged by a horizontal force by the hook member pulling (or pushing) the rail foot contact member into a wedge-shaped rail foot tip. The clipping device is maintained at the clipping location by a horizontal pulling force by a locking hook hooked to the other side rail foot tip.

The foregoing summary is neither intended to define the invention of the application, which is measured by the claims, nor is it intended to be limiting as to the scope of the invention in any way.

BRIEF DESCRIPTION OF DRAWINGS

Description of Drawings

Figure 1A:
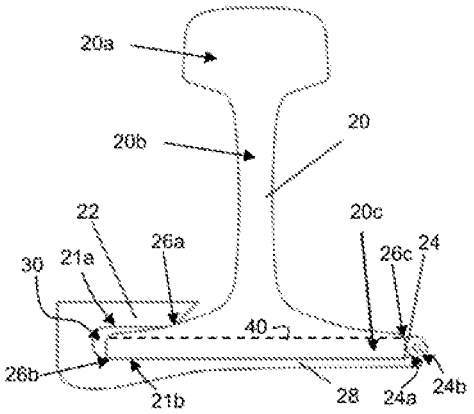

The foregoing and further features of the present invention will be apparent from the following description of embodiments which are provided by way of example only in connection with the accompanying figures, of which:

FIG. 1*a* is a front view of a rail damper mounting apparatus according to a first embodiment of the invention when it is installed to a rail, in which a mounting device for dampers is not shown.

Figure 1B:
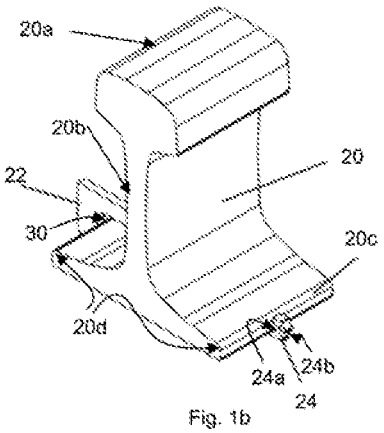

FIG. 1*b* is a perspective view of the rail damper mounting apparatus installed in the rail in FIG. 1*a*.

Figure 2A:
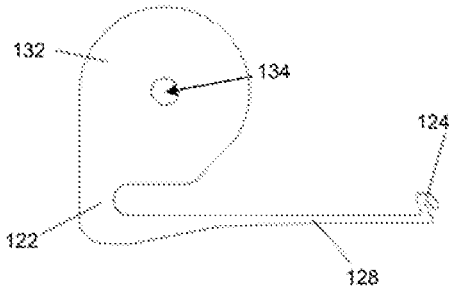

FIG. 2*a* is a front view of a rail damper mounting apparatus according to a second embodiment of the invention without showing the rail.

Figure 2B:
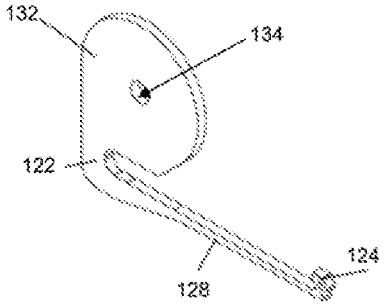

FIG. 2*b* is a perspective view of the rail damper mounting apparatus in FIG. 2*a*, without any dampers installed.

Figure 2C:
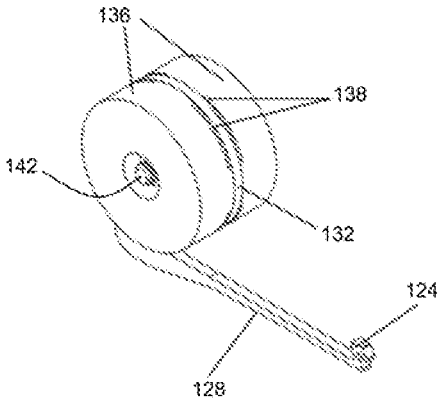
Figure 2D:
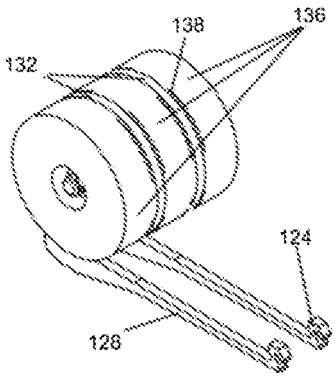

FIGS. 2*c* and 2*d* show respectively two circular oscillators installed to the rail damper mounting apparatus, and three circular oscillators installed to two rail damper mounting apparatuses of FIG. 2*a* in perspective views.

Figure 3A:
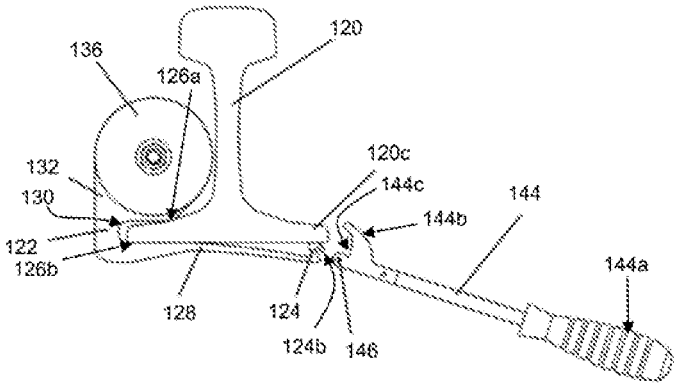
Figure 3B:
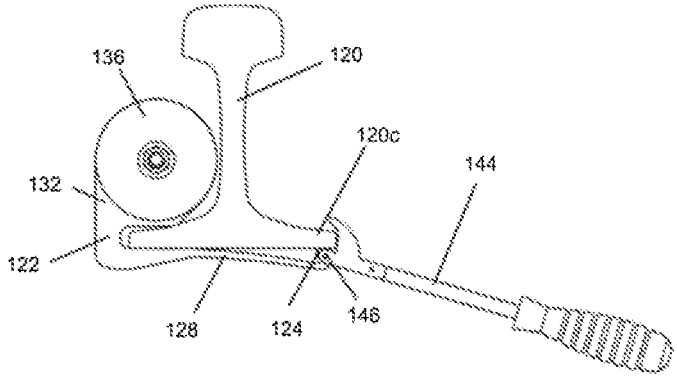
Figure 3C:
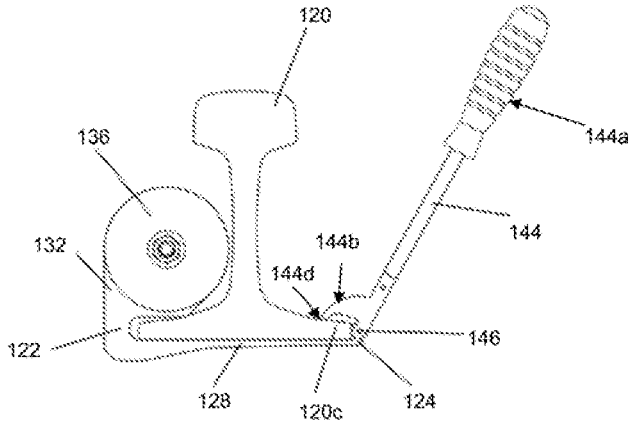

FIGS. 3*a*-3*c* show different steps of a method of clipping a rail damper mounting apparatus of FIGS. 2*a*-2*c* onto a rail using an external tool, in front views.

Figure 4A:
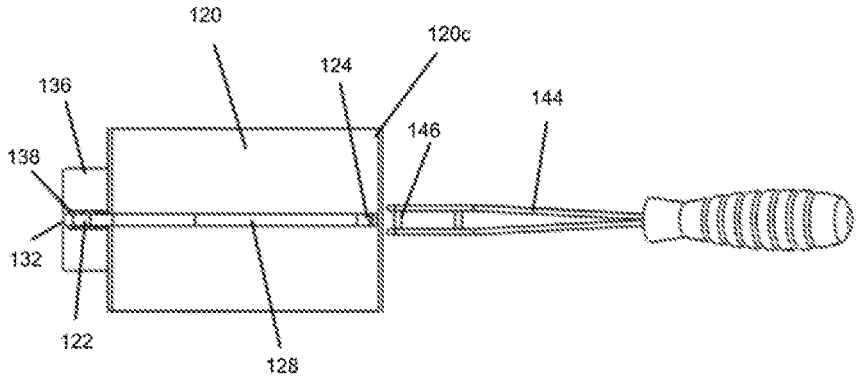
Figure 4B:
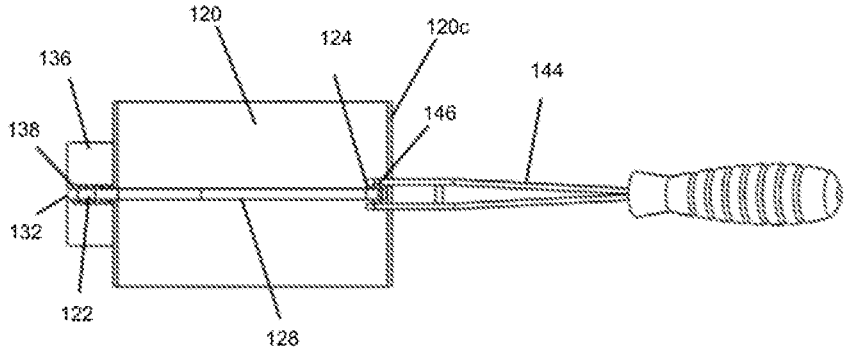
Figure 4C:
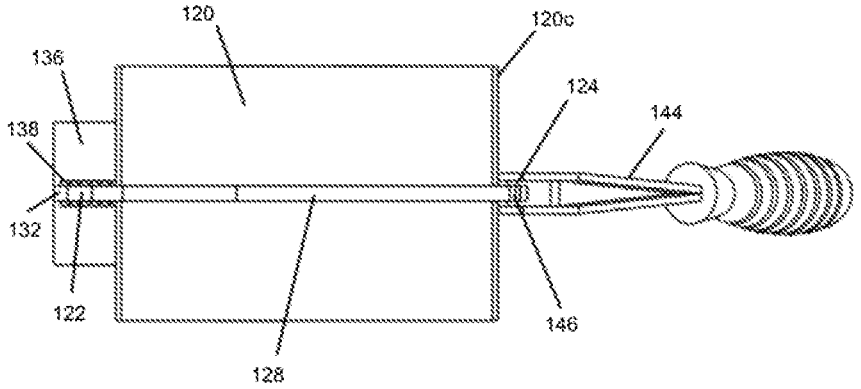

FIGS. 4*a*-4*c* correspond respectively to FIGS. 3*a*-3*c*, and show the steps of the method in bottom views.

Figure 5A:
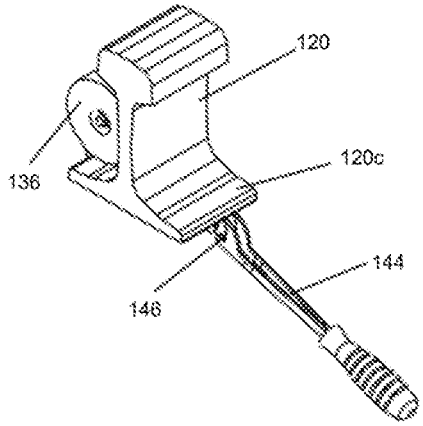
Figure 5B:
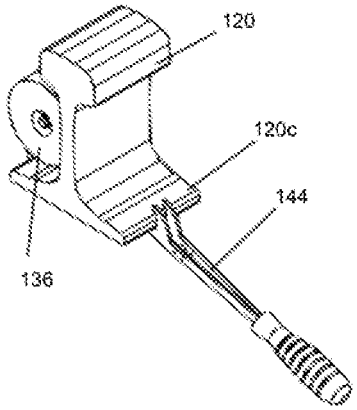
Figure 5C:
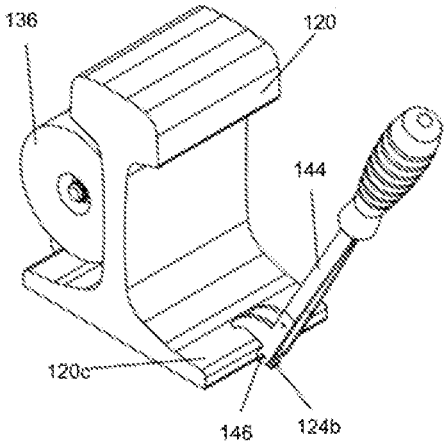
Figure 6A:
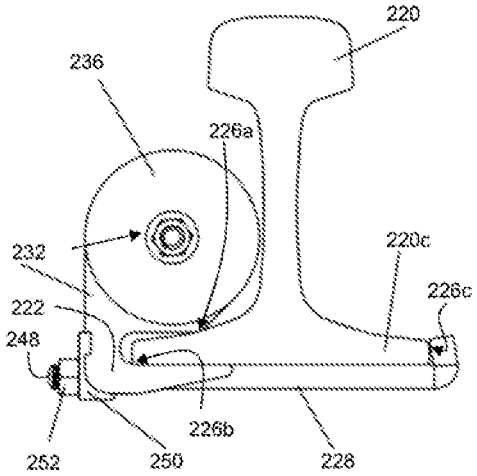
Figure 6B:
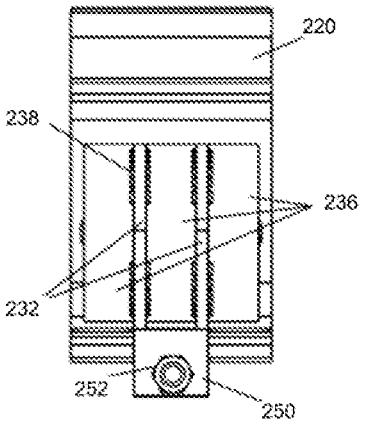
Figure 6C:
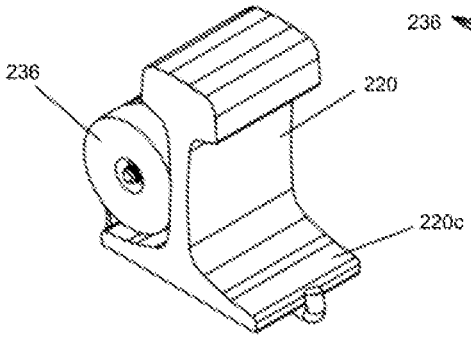
Figure 6D:
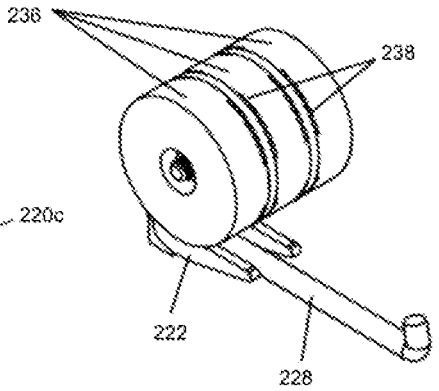

FIGS. 5*a*-5*c* correspond respectively to FIGS. 3*a*-3*c*, and show the steps of the method in perspective views.

FIGS. 6*a*-6*d* show different views of a rail damper mounting apparatus according to a third embodiment of the invention when it is installed to a rail, with three oscillators installed to a mounting device in the rail damper mounting apparatus.

Figure 7A:
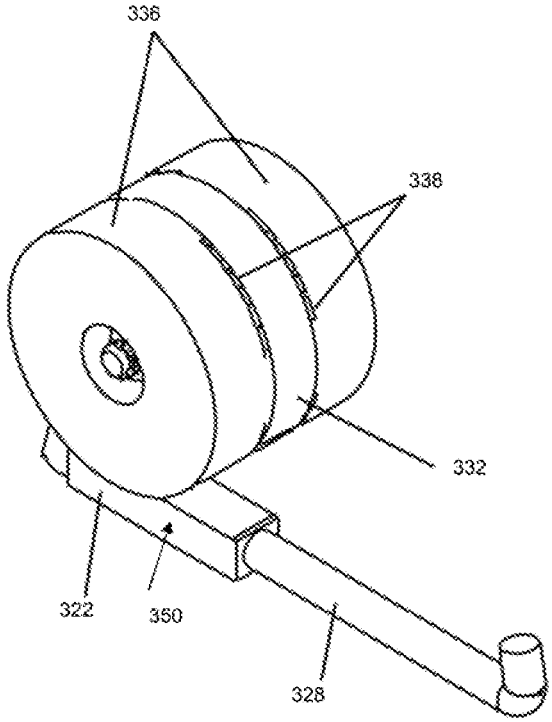
Figure 7B:
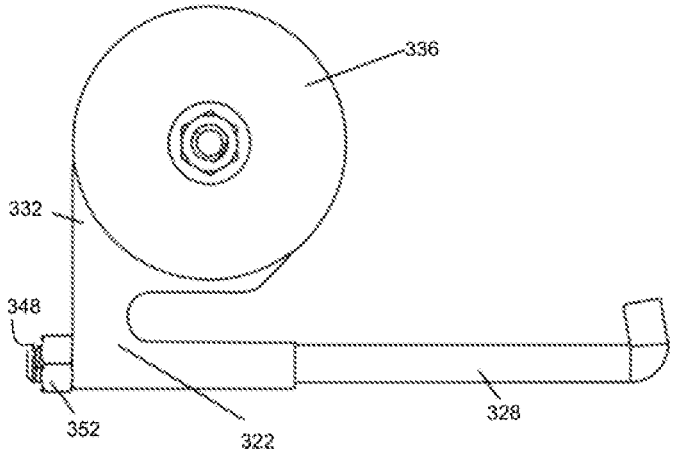

FIGS. 7*a*-7*b* show different views of a rail damper mounting apparatus according to a fourth embodiment of the invention when it is installed to a rail, with two oscillators installed to a mounting device in the rail damper mounting apparatus.

Figure 8A:
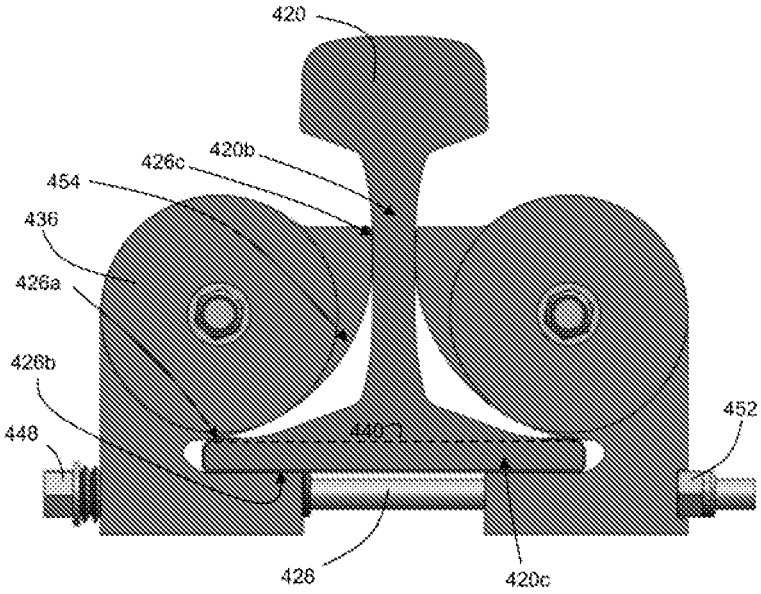

FIG. 8*a* shows two rail damper mounting apparatuses according to a fifth embodiment of the invention when they are installed to two sides of a rail, in a front view.

Figure 8B:
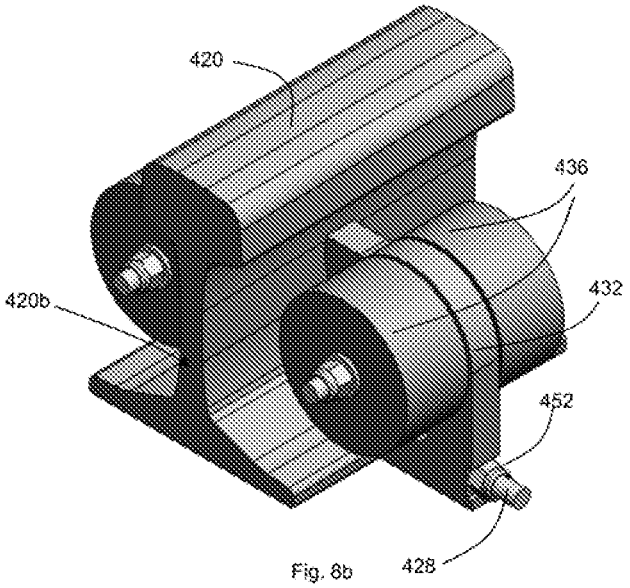
Figure 9A:
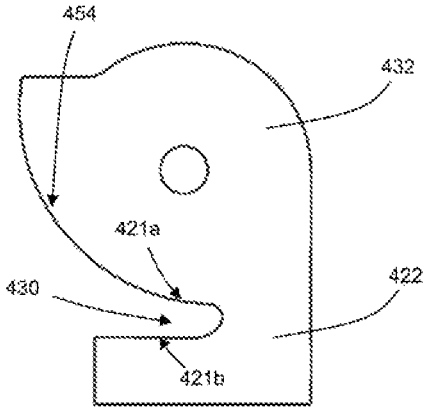

FIG. 8*b* shows the configuration in FIG. 9*a* in a perspective view.

Figure 9B:
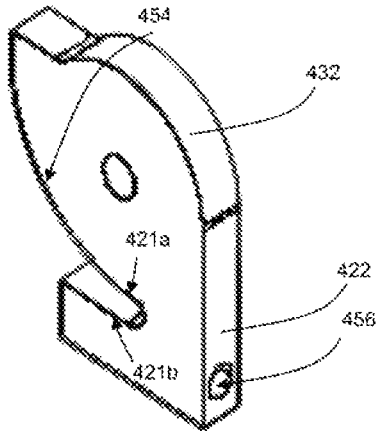

FIG. 9*a* and FIG. 9*b* respectively show the front view and perspective view of a rail damper mounting apparatus in FIG. 8*a*.

Figure 10A:
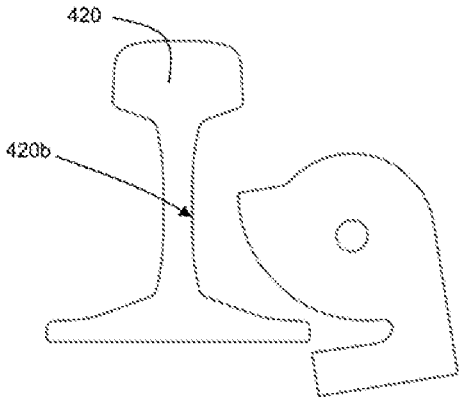
Figure 10B:
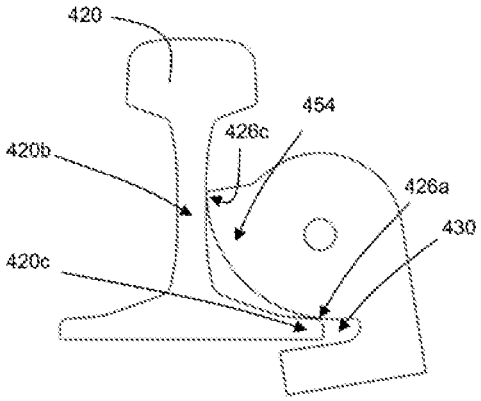
Figure 10C:
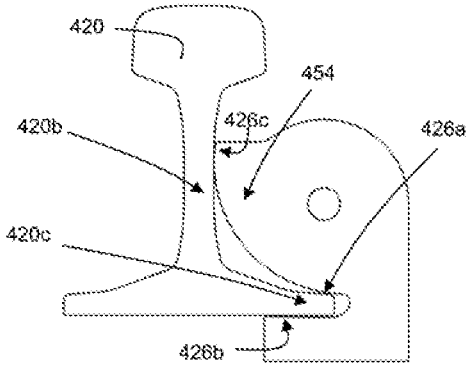

FIGS. 10*a*-10*c* show different steps of a method of clipping two rail damper mounting apparatuses of FIG. 8*a* to a rail.

In the drawings, like numerals indicate like parts throughout the several embodiments described herein.

MODE FOR THE INVENTION

Mode for Invention

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

As used herein and in the claims, "couple" or "connect" refers to electrical coupling or connection either directly or indirectly via one or more electrical means unless otherwise stated.

Terms such as "horizontal", "vertical", "upwards", "downwards", "above", "below" and similar terms as used herein are for the purpose of describing the invention in its normal in-use orientation and are not intended to limit the invention to any particular orientation.

FIGS. 1*a*-1*b* show a rail damper mounting apparatus according to a first embodiment of the invention when it is attached to a rail 20. The rail 20 has a typical flat-bottom profile that is standard to most modern railway systems in the world. The rail 20 has a foot 20*c*, a web 20*b*, and a head 20*a*. In the embodiment of FIGS. 1*a*-1*b*, it is the foot 20*c* of the rail 20 onto which the rail damper mounting apparatus is clipped. The rail damper mounting apparatus is installed to the outer side of the rail 20*b*, i.e. the side adjacent to an end of the sleeper (not shown). The rail damper mounting apparatus includes a clipping device 22 and a hook member 24, which is connected by an extension arm 28. The clipping device 22 forms a substantially "U" shape, which defines a slot 30 for receiving one end of the foot 20*c* of the rail 20 from a side direction. The clipping device 22 is therefore also referred to as a rail foot contact member in this embodiment. The side direction of the rail 20 is defined as the direction that is parallel to the flat bottom face of the foot 20*c*, and that is substantially perpendicular to the web 20*b*. The slot 30 has a substantially uniform width between its two side walls 21*a*, 21*b* which are almost parallel to each other, despite that the foot 20*c* of the rail 20 does not exhibit such a contour. Rather, the foot 20*c* of the rail 20 has the flat bottom face that form-fits with the side wall 21*b* of the slot 30, but an upper face of the foot 20*c* (there are two such upper faces on two sides of the web 20*b*) has a curved shape that rises as it extends toward the web 20*b* of the rail 20. In this way, the clipping device 22 forms two clipping points with the foot 20*c* of the rail 20 when the rail damper mounting apparatus is clipped onto the rail 20, namely a first clipping point 26*a* and a second clipping point 26*b*. The first clipping point 26*a* is located above a plane 40 defined by two foot tips of the foot 20*c* of the rail 20, and such a plane 40 is parallel to the bottom face of the foot 20*c*. The first clipping point 26*a* is located at the contact point between a free end tip of the side wall 21*a* of the slot 30 and one of the upper faces of the foot 20*c* when the rail damper mounting apparatus is installed. On the other hand, the second clipping point 26*b* is located under the plane 40 and is located at the contact point between a bottom end tip of the foot 20*c* and the side wall 21*b* of the slot 30.

To achieve a robust clipping effect for the rail damper mounting apparatus, a third clipping point is required beside the first clipping point 26*a* and the second clipping point 26*b*. The third clipping point 26*c* is located far away from the clipping device 22, as it is formed at the contact point between an inward end tip of a hook member 24 and a side of the foot 20*c* of the rail 20. The hook member 24 is designed to hook on the end of the foot 20*c* opposite to the one to which the clipping device 22 is clipped onto. In particular, the hook member 24 is to be hooked to a tip of the foot 20*c* at the other side of the rail 20 in order to provide a tension force for preventing the clipping device 22 from slipping off the foot 20*c*. The hook member 24 is curved inwardly (i.e. toward the foot 20*c* of the rail 20) to form the inward tip, but the hook member 24 further extends outwardly from the inward tip in the direction substantially away from the foot 20*c* of the rail 20 to form a hook portion 24*b*. The hook portion 24*b* is substantially along a vertical direction (i.e. perpendicular to the bottom face of the foot 20*c*) and is intended to complete the clipping process of the rail damper mounting apparatus to the rail 20 by the user using an external tool as will be described later. As one can see from FIG. 1*a* the hook member 24 in a front view exhibits substantially the shape of an inverted "2".

The hook member 24 is connected to the clipping device 22 via the extension arm 28 where the three are formed as a single piece. The extension arm 28 has a thinner cross-section than that of any portion of the clipping device 22, in order to allow flexible movement of the extension arm 28 along the vertical direction while applying only minimal additional stress to the clipping device 22 (e.g. less than 1% of the yield stress of the clipping device 22). Besides, the flexibility in vertical movement of the hook member 24 is an important feature in the installation process such that the frictional force at the clipping locations at the wedge-shapes foot 20*c* of the rail 20 would be strong enough to prevent the clipping device 22 from slipping back during the clipping process. That is, during the pulling (or pushing) of the clipping device 22 into the wedge-shaped foot 20*c*, the clipping device 22 does not immediately slide back when the pulling force stops. However, if the flexibility of the vertical movement is not enough, the clipping device 22 would immediately slide back once the pulling (or pushing) force stops during the installation process. As shown in FIG. 1*a*, even for the extension arm 28 per se, its cross-sectional size varies from a larger size to a smaller size along the direction toward the hook member 24. However, the top face of the extension arm 28 is made flat which completely fit to the bottom face of the rail 20 when the rail damper mounting apparatus is installed.

It should be noted that an oscillator or its mounting device is not shown in FIGS. 1*a*-1*b*. However, various types of damper mounting devices can be configured with the rail damper mounting apparatus, e.g. by using a fastener or by forming the mounting device integrally with the clipping device 22 as will be illustrated in other embodiments that will be described below.

Turning to FIGS. 2*a*-2*b*, which shows a rail damper mounting apparatus according to another embodiment, and in this rail damper mounting apparatus the clipping device 122, the extension arm 128 and the hook member 124 are identical to those in FIGS. 1*a*-1*b*, which will not be described in details again. What is different in the rail damper mounting apparatus as shown in FIGS. 2*a*-2*b* as compared to that in FIGS. 1*a*-1*b* is that a mounting device 132 for oscillator(s) is integrally formed with the upper part of the clipping device 122 in FIGS. 2*a*-2*b*. The mounting device 132 has most of its perimeter in curved shape, and remaining parts of its perimeter transit to the clipping device 122. A screw hole 134 is formed at the center of a hypothetical circle (not shown) defined by the curved edge of the mounting device 132, so that oscillator(s) (not shown) may be mounted on the mounting device 132 using a screw (not shown in FIGS. 2*a*-2*b*). The mounting device 132 is a metal plate combined with the clipping device 122 without a joint, and has the same thickness all along itself. As shown in FIGS. 2*a*-2*b*, all of the mounting device 132, the clipping device 122, the extension arm 128 and the hook member 124 are formed as a single piece.

FIG. 2*c* shows the configuration of two oscillators 136 installed to the rail damper mounting apparatus in FIGS. 2*a*-2*b*. Each oscillator 136 is a shearing TMD oscillator that is the most efficient vibration absorber for reduction of rail vibration in general, and it comes in a round shape. In FIG. 2*c*, the two oscillators 136 are installed to the mounting device 132 on two sides of the plate shape of the mounting device 132 in order to provide balanced inertia and TMD reaction force, and they are fastened together using a screw 142. Between the mounting device 132 and each of the oscillators 136, there is sandwiched a resilient damping material 138 for better energy dissipation by the oscillators 136.

FIG. 2*d* shows the configuration of three oscillators 136 installed to two identical rail damper mounting apparatuses as shown FIGS. 2*a*-2*b*. In particular, a middle oscillator 136 is sandwiched between two mounting devices 132 of the two rail damper mounting apparatuses. On another side (i.e. the open side) of each of the mounting devices 132, there is configured an oscillator 136, so the two mounting devices 132 are effectively sandwiched by the three oscillators 136 in an alternating manner. Again, in FIG. 3*b* a resilient damping material 138 is sandwiched between any mounting device 132 and its adjacent oscillators 136.

Turning to FIGS. 3*a*-5*c*, in which the steps of the user clipping the rail damper mounting apparatus in FIG. 2*c* onto a rail are illustrated. Note that the status of the rail damper mounting apparatus in FIGS. 3*a*, 4*a* and 5*a* is the same, and so are FIGS. 3*b*, 4*b* and 5*b*, and FIGS. 3*c*, 4*c* and 5*c*. Also, in FIGS. 4*a*-4*c* the rail damper mounting apparatus is shown to have been connected with two oscillators 136, but the installation method described herein is not relevant to the number of oscillators installed to a rail damper mounting apparatus, since it is the clipping device 122 and the hook member 124 that are used to clip onto the rail 120.

To install the rail damper mounting apparatus, the user first need to inserts the slot 130 of the clipping device 122 into one end of the foot 120*c* of the rail 120. When the clipping device 122 is installed fully by pressing it to the maximum extent toward the foot 120*c*, a first clipping point 126*a* and a second clipping point 126*b* will be formed, which are located at the same positions as mentioned for those in FIGS. 1*a*-1*b*. At this time, however, a third clipping point has not been formed yet, and because of the insertion of the slot 130 into the foot 120*c*, the hook member 124 is pressed against a bottom face of the foot 120*c* due to a resilience of the extension arm 128 connecting the hook member 124 to the clipping device 122. To engage the hook member 124 properly with the foot 120*c* of the rail 120, the user uses an external tool generally in the form of a level bar 144. The level bar has a handle portion 144*a* connected to a head portion that contains an anchor pin 146 adapted to be fitted into a specifically designed anchor slot formed a hook portion 124*b* of the hook member 124. Next to the anchor pin 146, on the head portion of the level bar 144 there is also a curved member 144*b* that extends from a longitudinal direction of the level bar perpendicularly, and then forwardly as opposite to the handle portion 144*a*. As best shown in FIGS. 4*a*-5*c*, the head portion for the level bar 144 has a parallel-plate shape defining the curved member 144*b*, and also a recess in which the hook portion 124*b* can be received at least partially, and the anchor pin 146 is fixed between the parallel plates of the head portion so that it can be further received by the hook portion 124*b* of the hook member 124. The lever bar 144 could for example have a lever ratio of 10 to 50 providing amplified pulling force ranging from 100 to 1000 kg.

FIGS. 3*a*, 4*a* and 5*a* show the status where the level bar 144 has not engaged with the hook member 124. To hook the hook member 124 to the foot 120*c*, the user insert the anchor pin 146 into the recess of the hook portion 124*b* of the hook member 124, and at the same time a concave part 144*c* of the curved member 144*b* is pressed against an side face of the foot 120*c*, as shown in FIGS. 3*b*, 4*b* and 5*b*. Finally, from the status in FIGS. 3*b*, 4*b* and 5*b*, the user lifts up the handle portion 144*a* making the level bar 144 pivots substantially around the tip 144*d* of the curved member 144*b* which will contact the upper surface of the foot 120*c*. Then, the pivoting of the level bar 144 results in the anchor pin 146 and in turn the hook member 124 of the rail damper mounting apparatus to also move upward, ultimately wrapping partially the end of the foot 120*c* and forming the third clipping point similar to that describes in FIGS. 1*a*-1*b* (but not shown in FIGS. 3*a*-5*c*). The clipping of the rail damper mounting apparatus onto the rail 120 is then completed as three clipping points are formed, and similar to the status shown in FIGS. 2*a*-2*d*, the upper surface of the extension arm 128 now fits to the bottom face of the foot 120*c*.

FIGS. 6*a*-6*d* show another embodiment of the invention, where two rail damper mounting apparatuses carry three oscillators 236 on their respective mounting devices 232. Each of the rail damper mount apparatus in FIGS. 6*a*-6*d* is substantially the same as that shown in FIG. 2*d*, except that there is no integral extension arm or hook member formed with the clipping device 222. Rather, the clipping device 222 in FIGS. 6*a*-6*d* now only have a length not exceeding a diameter of the oscillators 236. In addition, the two clipping devices 222 of the rail damper mounting apparatuses are connected to a common pushing plate 250 which has a through hole (not shown) that allows a screw 248 to be threaded in. To complete the three-points clipping of the rail damper mounting apparatuses, a separate screw hook 228 is fixed to the clipping devices 222 via the pushing plate 250. During installation of the rail damper mounting apparatuses in FIGS. 6*a*-6*d*, the initial steps of clipping the clipping devices 222 onto the foot 220*c* of the rail 220 are similar to that described with respect to FIGS. 3*a*, 4*a* and 5*a*. Once the clipping device 222 are clipped forming the first and second clipping points 226*a*, 226*b*, the user then engages the screw hook 228 with another end of the foot 220*c* opposite to the clipping device 222, thus forming the third clipping point 226*c*, and then the user connect the clipping devices 222 and the screw hook 228 by fastening screw 248 into the pushing plate 250 and connecting the pushing plate 250 and the screw hook 228 together, by turning a nut 252.

FIGS. 7*a*-7*b* show another embodiment of the invention, where one rail damper mounting apparatus carries two oscillators 336 on its mounting device 332. The method of installing the rail damper mounting apparatus of FIGS. 7*a*-7*b* is substantially the same as that in FIGS. 6*a*-6*d*, but the fixing structure of the rail damper mounting apparatus is slightly different. In particular, there is no pushing plate as a separate component in FIGS. 7*a*-7*b*. Rather, the lower portion 350 of the clipping device 322 of the rail damper mounting apparatus is broadened to form a circular through hole therein that allows a screw hook 328 to be inserted. A screw 348 is used to connect the screw hook 328 to the clipping device 322 of the rail damper mounting apparatus, and the screw 348 is locked by a nut 352. The shape of the lower portion 350 is cubic. As the mounting device 332 is formed integrally with the clipping device 322, one can see that the width of the mounting device 322 is also increased as compared to that in FIGS. 1*a*-6*d*.

Turning to FIGS. 8*a*-9*b*, in another embodiment of the invention a pair of the rail damper mounting apparatuses are symmetrically installed on two sides of a rail 420. The two rail damper mounting apparatuses are connected by a screw arm 428 which is secured by a nut 452 at its tail end. The two rail damper mounting apparatuses are almost the same to each other, and both contain a through hole 456 at a lower portion of the clipping device 422. Each damper mounting apparatus further contains a mounting device 432 to which two oscillators 436 are installed on two ends thereof. Thus, in FIG. 8*b* one can see that there are in total four oscillators 436. What is different in the rail damper mounting apparatuses in FIGS. 8*a*-9*b* as compared to those in previously described embodiment, is that there are a second clipping point 426*c* and a first clipping point 426*a* formed above a plane 440 defined by two foot tips of the foot 420*c* of the rail 420, and a third clipping point 426*b* formed below the plane 440. To achieve this, the mounting device 432 has part of its perimeter further extended radially outwardly from the rotating center at the intersection point defined by two normal lines respectively to tangential lines at the first clipping point 426*a* and the second clipping point 426*c*, thus forming a chamfered member 454. The chamfered member 454 defines a side edge that has a curved shape, and when the rail damper mounting apparatus is installed as shown in FIG. 8*a* the side edge is pressed against the web 420*b* of the rail 420 to form the second clipping point 426*c* at a tip of the chamfered member 454. Thus, the chamfered member 454 is also referred to as a rail web contact member in this embodiment. The side edge as best seen in FIG. 8*a* is internally tangent with a circle defined by the contour of the oscillator 436.

Below the mounting device 432 there is integrally formed a clipping device 422 which defines a slot 430 for receiving one end of the foot 420*c* of the rail 420 from a side direction. Unlike the case in FIGS. 1*a*-7*b*, the two side walls 421*a*, 421*b* of the slot 430 are no longer parallel to each other. Rather, the upper side wall 421*a* is part of the side edge of the chamfered member 454 and they form together a smooth curve, which has a curvature larger than that of the top edge of the mounting device 432 (as best seen in FIG. 9*a*).

Turning to FIGS. 10*a*-10*c*, in which the steps of the user clipping the rail damper mounting apparatus in FIGS. 9*a*-9*b* are illustrated. FIG. 10*a* shows the status where the rail damper mounting apparatus has not contacted the rail 420. To install the rail damper mounting apparatus in FIGS. 9*a*-9*b* to the rail 420, the user first needs to insert the slot 430 of the clipping device 422 into one end of the foot 420*c* of the rail 420, and at the same time makes the tip of the chamfered member 454 touching the web 420*b* of the rail 420. This is shown in FIG. 10*b*, where by the above steps the first clipping point 426*a* and the second clipping point 426*c* are formed. The first and second clipping points 426*a*, 426*c* are located on the side edge at a similar radial distance from a rotating center of the rail damper mounting apparatus that is located at the intersection point defined by two normal lines respectively to tangential lines at the first clipping point 426*a* and the second clipping point 426*c*. Then, the user further pushes the rail damper mounting apparatus to pivot around the tip of the chamfered member 454, that is around the second clipping point 426*c*, so that the rail damper mounting apparatus pivots along a clockwise direction from the status in FIG. 10*b* to that in FIG. 10*c*. When the clipping device 422 is installed fully by pressing it to the maximum extent toward the foot 420*c*, the third clipping point 426*b* will be formed, thus the three-point clipping structure has been formed. It is clear that in the installation method of FIGS. 10*a*-10*c*, no external tool is required.

The exemplary embodiments are thus fully described. Although the description referred to particular embodiments, it will be clear to one skilled in the art that the invention may be practiced with variation of these specific details. Hence this invention should not be construed as limited to the embodiments set forth herein.

While the embodiments have been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

It is to be understood that, if any prior art publication is referred to herein, such reference does not constitute an admission that the publication forms a part of the common general knowledge in the art, in Australia or any other country.

In the embodiments mentioned above, each rail damper mounting apparatus contains a single piece of mounting member in a plate shape. However, a variation of the preferred embodiments could be that the mounting device is formed by identical two mounting members of the same shape, but each with half the thickness of a mounting device in the embodiments described above. The two half mounting devices are jointed together by the compression force exerted on the resilient materials on both side of the mounting devices. This arrangement provides a better balanced mounting force by allowing relative movement between the two mounting members during the damper installation on uneven mounting surfaces. The thinner half-thickness mounting device design also facilitates the manufacturing process by using laser cutting.

In the embodiments described above, the clipping device as a plate-like piece is directly made into contact with the wedge-liked rail foot. However, those skilled in the art should realize that the clipping device may also be made into indirect contact with other material or member at the interface.

In the embodiments, the rail that the rail damper mounting apparatus is suitable to use with has a flat-bottom profile which is common in most modern railways. However, one should realize that other types of rails may also be suitable to be used by the rail damper mounting apparatus according to the invention which may have different cross-sectional shapes.

In the embodiments mentioned above, one to two oscillators are installed on each rail damper mounting apparatus. However, it should be realized that any number of oscillators may be installed on a rail damper mounting apparatus depending on the type and number of mounting devices.

The invention claimed is:

1. A rail damper mounting apparatus, comprising:

a) a clipping device adapted to clip onto a rail;

b) a mounting device adapted to allow an oscillator to secure thereto;

wherein the rail damper mounting apparatus forms at least three clipping points with a rail when the rail damper mounting device is installed to the rail;

wherein the mounting apparatus forms two clipping points located above a plane defined by foot tips of the rail on two sides of the rail, and one clipping point below the plane, when the rail damper mounting apparatus is installed to the rail;

wherein the clipping device comprises a rail web contact member and a rail foot contact member; the rail web contact member forming a first clipping point and a second clipping point above the plane at a foot and a web of the rail respectively, when the rail damper mounting apparatus is installed to the rail; the rail foot contact member forming a third clipping point below the plane at the foot of the rail; the rail web contact member having a side edge in a curved shape that faces the web of the rail when the rail damper mounting apparatus is installed to the rail;

wherein the rail web contact member is formed as a single piece with the rail foot contact member; the side edge forming the first and second clipping points when the rail damper mounting apparatus is installed to the rail; and wherein the first and second clipping points are located on the side edge at substantially the same radial distance from a rotating center defined by an intersection of two lines respectively normal to tangential lines at the first and second clipping points.

2. The rail damper mounting apparatus of claim 1, wherein the rail web contact member is formed as a single piece with the mounting device, where the side edge at least partially follows the contour of an oscillator installed to the mounting device.

3. The rail damper mounting apparatus of claim 1, wherein the rail foot contact member contains a slot for receiving the foot of the rail from a side direction; the clipping point formed between a bottom face of the foot of the rail and the slot when the rail damper mounting apparatus is installed to the rail.

4. The rail damper mounting apparatus of claim 1, wherein the mounting device has a plate shape; the mounting device adapted to allow two oscillators to secure thereto at two sides of the plate shape.

5. The rail damper mounting apparatus of claim 1, wherein the rail damper mounting apparatus is adapted to be connected to a similar rail damper mounting apparatus on an opposite side of the rail by an extension arm.

6. A rail damper mounting apparatus, comprising:

a) a clipping device adapted to clip onto a rail;

b) a mounting device adapted to allow an oscillator to secure thereto;

wherein the rail damper mounting apparatus forms at least three clipping points with a rail when the rail damper mounting device is installed to the rail;

wherein the mounting apparatus forms one clipping point located above a plane defined by foot tips of the rail on two sides of the rail, and two clipping points below the plane, when the rail damper mounting apparatus is installed to the rail;

wherein the clipping device comprises a rail foot contact member and a hook member; the rail foot contact member forming respectively a first clipping point above the plane and a second clipping point below the plane with the foot of the rail, when the rail damper mounting apparatus is installed to the rail; the hook member forming a third clipping point with the foot of the rail.

7. The rail damper mounting apparatus of claim 6, wherein the rail foot contact member and the hook member are located on the two sides of the rail, and are connected through an extension arm that runs parallel to a bottom face of the foot of the rail when the rail damper mounting apparatus is installed to the rail.

8. The rail damper mounting apparatus of claim 7, wherein the extension arm is at least partially resilient so that the clipping device can be clipped onto the rail by moving the hook member in a direction substantially perpendicular to a longitudinal direction of the extension arm using an external tool.

9. The rail damper mounting apparatus of claim 7, wherein the clipping points are located at the bottom face of the foot of the rail when the rail damper mounting apparatus is installed to the rail.

10. The rail damper mounting apparatus of claim 6, wherein the hook member forms an inward tip which is adapted to contact the foot of the rail to form the third clipping point.

11. The rail damper mounting apparatus of claim 10, wherein the hook member comprises a hook portion having an opening substantially toward a direction away from the foot of the rail when the rail damper mounting apparatus is installed to the rail.

12. A rail damper system comprising:

a) A plurality of rail damper mounting apparatus according to claim 1 that are installed to a railway;

b) An oscillator installed to each said rail damper mounting apparatus;

wherein the plurality of rail damper mounting apparatus is positioned along a longitudinal direction of a rail, and/or positioned symmetrically on rail of the railway.

* * * * *